United States Patent [19]

Eckold et al.

[11] 4,092,840

[45] June 6, 1978

[54] DEVICE FOR FLANGING THE EDGES OF SHEET SECTIONS

[75] Inventors: Gerd-Jürgen Eckold, St. Andreasberg; Hans Maass, Bad Lauterberg, both of Germany

[73] Assignee: Paweck AG, Chur, Switzerland

[21] Appl. No.: 749,401

[22] Filed: Dec. 10, 1976

[30] Foreign Application Priority Data

Oct. 21, 1976 Germany ..... 2527225

[51] Int. Cl.[2] ..... B21D 19/08

[52] U.S. Cl. ..... 72/312; 72/321; 72/465

[58] Field of Search ..... 72/296, 297, 306, 312, 72/319, 320, 321, 322, 380, 382, 388, 465, 210, 211; 113/120 R, 120 QA, 1 N, 57, 58

[56] References Cited

U.S. PATENT DOCUMENTS

| | | | |
|---|---|---|---|
| 40,951 | 12/1863 | Scofield et al. | 72/388 |
| 1,106,743 | 8/1914 | Smith | 72/319 |
| 1,765,807 | 6/1930 | Thomas | 72/465 |
| 2,436,278 | 2/1948 | Willett | 72/319 |
| 2,937,689 | 5/1960 | Peterson | 72/320 |
| 3,808,867 | 5/1974 | Becker | 72/321 |
| 4,002,049 | 1/1977 | Randolph | 72/313 |

*Primary Examiner*—Michael J. Keenan
*Attorney, Agent, or Firm*—Watson, Cole, Grindle & Watson

[57] ABSTRACT

Apparatus for bending the outer edge of sheet metal members includes a yoke having a substantially C-shaped contour. The sheet metal member is supported to be engaged with one of the legs of the yoke. A movable tool carrier is mounted on the yoke and includes a clamping member for retaining the sheet metal member against the support member and a bending member for engaging the edge of the sheet metal member to bend it about the support member in the desired shape. A reciprocating drive is connected to the yoke for actuating the clamping member and the bending member, and to move the tool carrier relative to the support member.

13 Claims, 10 Drawing Figures

Figure 1:
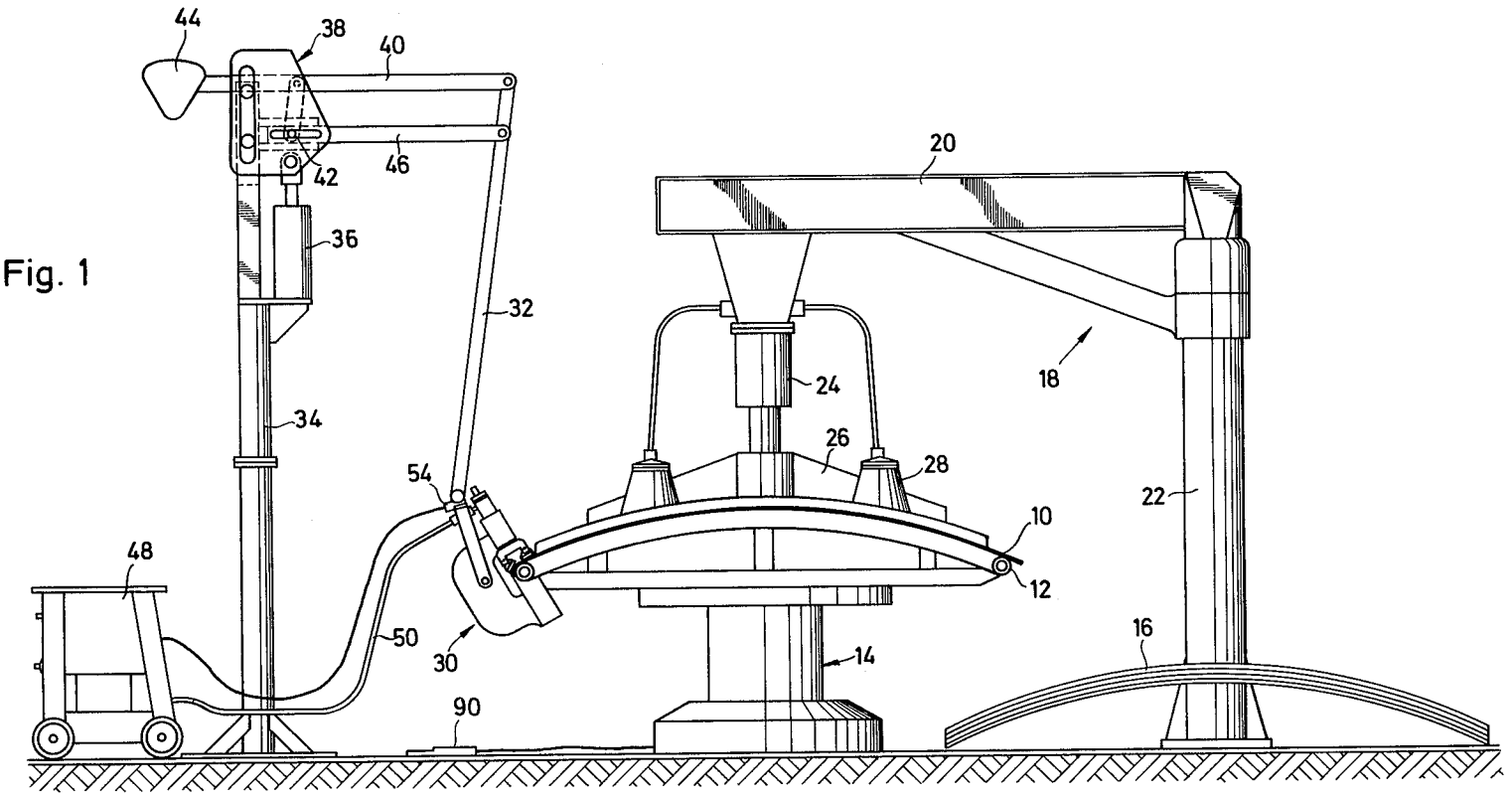

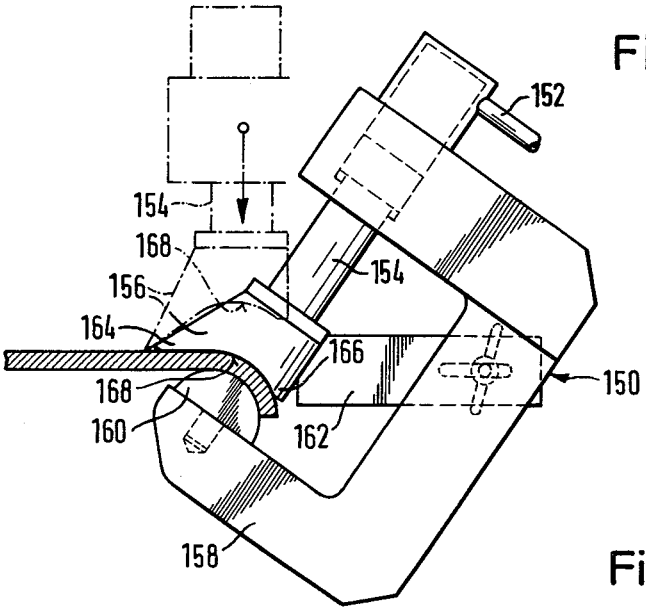
Fig. 8
Fig. 9
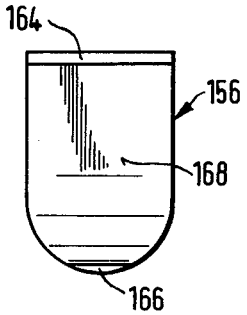
Fig. 10
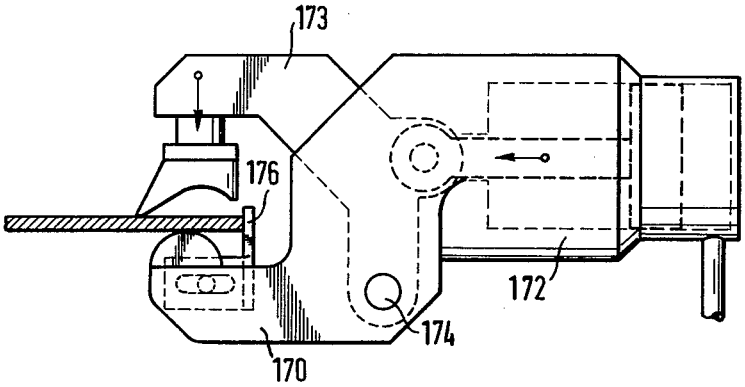

DEVICE FOR FLANGING THE EDGES OF SHEET SECTIONS

The invention relates to a device for bending with dimensional accuracy the edges of blanks of sheet metal of large area, in particular of arched blanks which are to form tank bases.

Although the invention is suitable for use on a large variety of large pieces of sheet metal, it is particularly suitable for the bending of sheet metal blanks for tank bases.

For the purpose of the description, a tank base is a base that is welded onto the end and side walls of a tank and also the dividing walls inside such a tank. Such a tank base is generally in the shape of a rectangle with rounded sides and corners, the rounded-off portion at one of the longer sides often having a different radius from that of the opposite lying side. Other, irregular shapes are often to be found. The entire base is sometimes arched, generally with a curvature about an axis parallel to the shorter sides of the rectangle.

In order to weld such a base to the tank body, the edge of the base is bent or flanged in such a manner that after bending, the edge is flush with the end face edge of the tank body, which is in the form of a tube with a cross-sectional shape corresponding to the contour of the base.

Of each type of tank base only a few tens or hundreds are manufactured in one run, it would be uneconomical to construct, for example, a deep-drawing tool for bending the edges since this would be of considerable dimensions because the usual dimensions of bases are more than a square meter. Another method was therefore used for bending the edges. In this method, a support is required for each type of tank base, the contour of the support matching that of the arched preformed tank base blank. The bending is carried out by hand with hammers, the material of the metal blank projecting beyond the support being bent around the outer contour of the support. The work is very noisy, involves a great deal of effort and takes time, and usually requires the edge portion of the blank to be preheated.

In the case of many other large blanks of sheet metal whose edges have to be bent or flanged, the use of a stamping tool or a deep-drawing tool involves capital expenditure which would be economical only for the production of extremely large numbers of pieces. By "large" is meant blanks whose surface area exceeds its thickness by two to four orders of magnitude.

The object of the invention is to create a device for carrying out such bending and flanging operations, which in comparison with working with a large tool has the advantage of less capital expenditure and in comparison with work by hand has the advantage of being quicker and more accurate.

According to the present invention a device for bending with dimensional accuracy the edges of sheet metal blanks which can be guided along the edges of the blank, the device including a yoke one arm of which forms the carrier for a unit for operating a bending tool.

Figure 2:
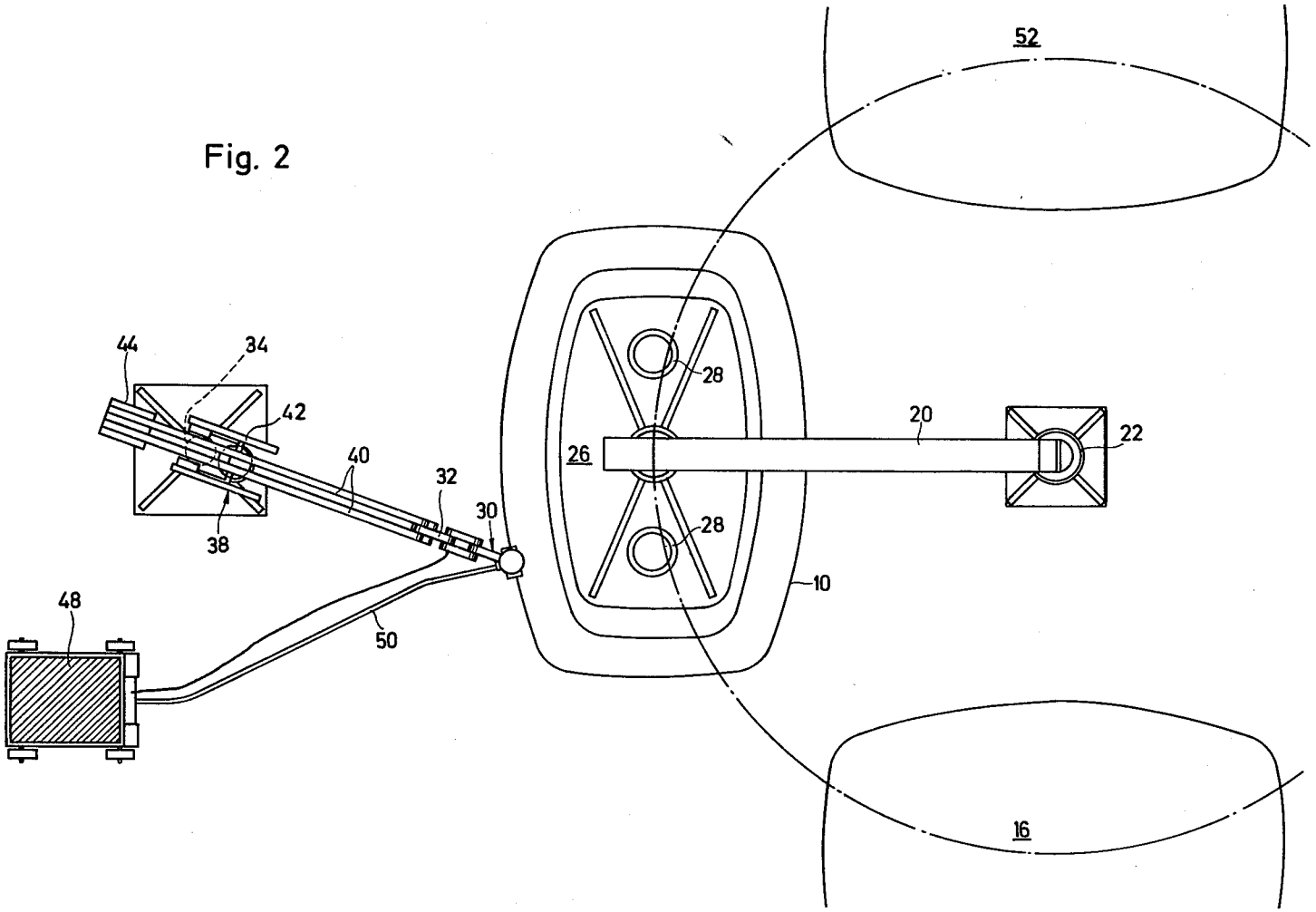
Figure 3:
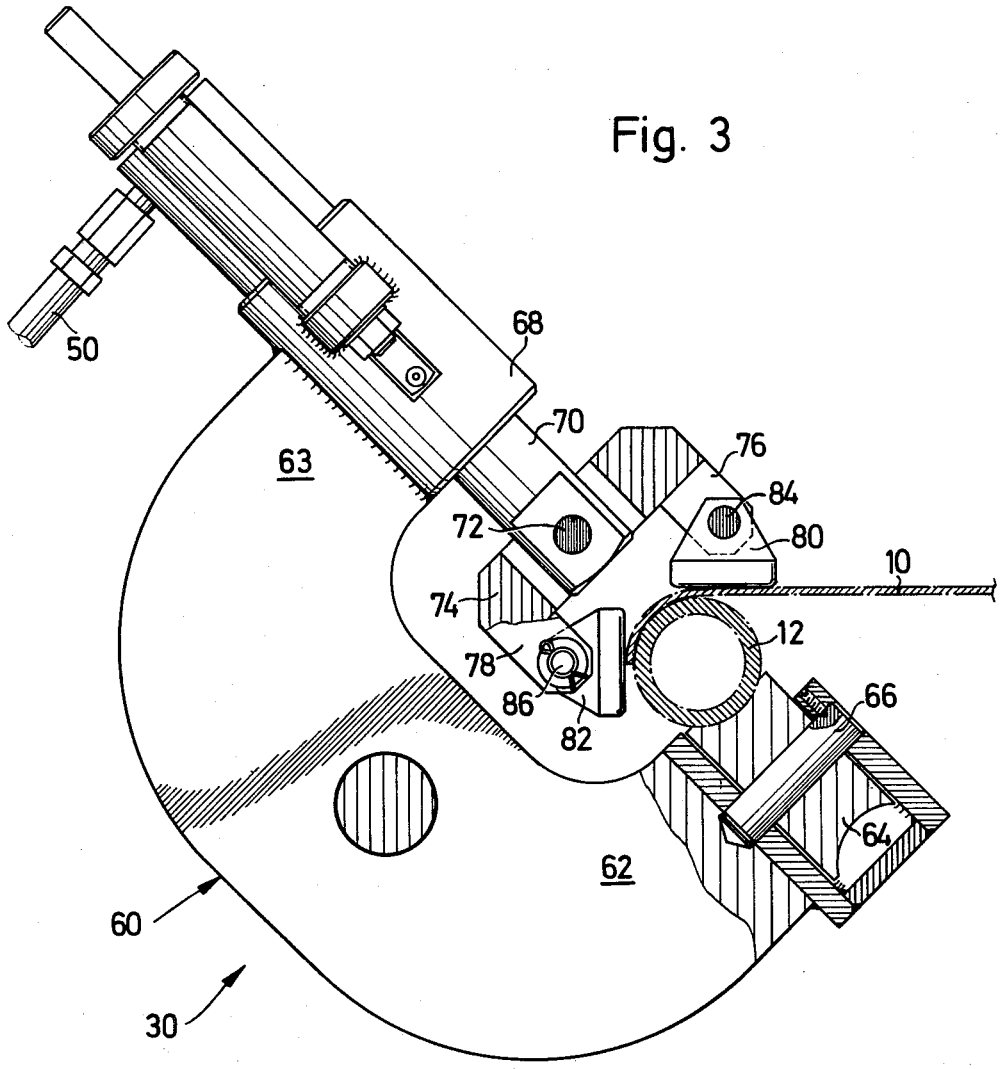
Figure 4:
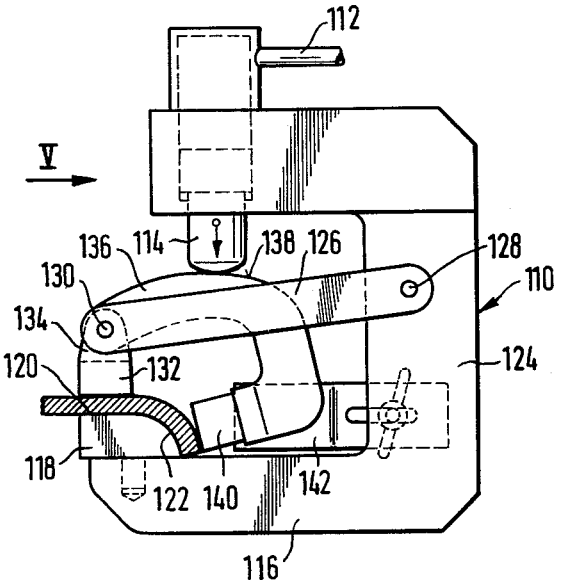
Figure 5:
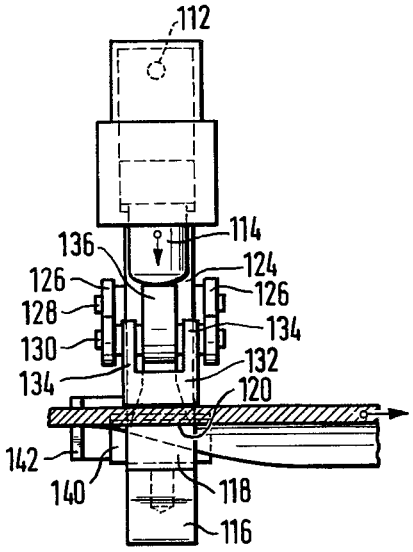
Figure 6:
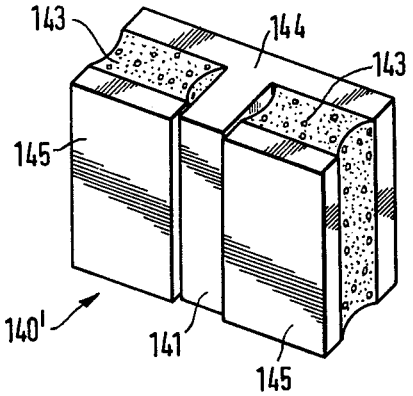
Figure 7:
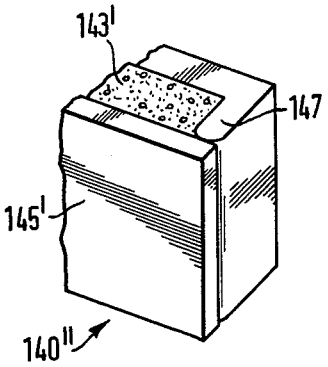

By way of example only, embodiments of the invention will now be described in greater detail with reference to the accompanying drawings, of which:

FIG. 1 is a side view showing in schematic form apparatus including a first embodiment of the invention suitable for bending tank bases, FIG. 2 is a plan view of the apparatus of FIG. 1, FIG. 3 is a side view, partly in section, of a flanging tool, on a scale greater than that of FIG. 1, FIG. 4 is a side view of a flanging tool according to a second embodiment of the invention, FIG. 5 is a view from the left of the tool of FIG. 4, FIG. 6 is a perspective view of a modified form of a part of the tool shown in FIG. 4, FIG. 7 is a perspective view of part of another modified form of part of the tool shown in FIG. 4, FIG. 8 is a side view of a flanging tool according to a third embodiment of the invention, FIG. 9 is a side view of the patrix of FIG. 8 from below, and FIG. 10 is a side view of a fourth embodiment of the invention.

FIGS. 1–3 show in its entirety apparatus for bending the edges of tank bases, whereas FIGS. 4–9 show only flanging tools or devices designed especially for blanks or workpieces that are initially flat.

In FIG. 1, there is shown a preformed, arched tank base blank 10 supported on a tubular frame 12 contoured to correspond to the curvature of the blank. The frame is, in turn, supported on a rotary table 14. A lifting mechanism 18 is used to lift the individual blank 10 from a pile 16 and place it on the frame 12. The lifting mechanism consists of an arm 20, pivotally mounted on a fixed stand 22 and a pressure plate 26 attached to the arm by way of a piston-cylinder unit 24. Also carried by the pivot arm 20 are suction means 28 by means of which the blank is lifted from the pile 16 and which hold the blank while it is aligned with the frame 12 before the pressure plate 26 is lowered by unit 24. The frame 12 is naturally interchangeable so as to be able to enable different shapes and sizes of blanks to be supported on the table 14.

Mounted adjacent to the table 14 is a device 30 shown in detail in FIG. 3. As is seen in FIGS. 1 and 2, the device 30 is so suspended that it can swing, pivot and rotate. The device 30 is mounted at the end of a carrier arm 32, which in turn is suspended from a gallows-like balancing mechanism. The mechanism consists of a column 34 supporting a head 38 which can be lifted and lowered by means of fluid-operated piston-cylinder unit 36. A cross arm 40 is pivotally mounted in the head 38 at 42 and carries, at one end, the carrier arm 32 and at the other end a balancing weight 44. A guide arm 46 completes the mechanism and with arm 40 forms a parallelogram arrangement. A unit 48 for supplying operating fluid under pressure is connected by way of a high pressure hose 50 to the device 30. The device 30 also carries a control device 54 for the unit 48, and the unit 36. The fluid may be either hydraulic or pneumatic.

The arrangement is so designed that by turning the table 14 it is possible for each portion of the edge of a base blank to be brought in succession into the operating region of the device 30 as determined by the extent of the cross arm 40. Once the flanging operation is complete the finished tank base is lifted from the frame 12 by means of the lifting mechanism 18 and placed on a pile 52 of completed bases.

The device 30 comprises a yoke 60, shaped approximately in the form of a C. At the lower arm 62 of the C there is arranged a hook-like mechanism capable of engaging the template tube 12 over its lower surface. This mechanism consists of a clamping wheel 64, of which the asymmetrically designed peripheral contour has a radius of curvature corresponding to the outer radius of the tube of which frame 12 is formed. The clamping wheel is rotatably mounted on the lower arm 62 by means of a pin 66.

The upper arm 63 of the yoke carries the cylinder of a fluid operated cylinder-piston unit 68 to the piston 70 of which there is hinged by means of pin 72 a punch supporting beam 74. The axis of the piston rod is aligned with the axis of the pin 66 and is perpendicular to it. Hinged by means of pins 84 and 86 respectively at two arms 76 and 78, which are attached at right angles to the supporting beam, are pressure pads 80 and 82 respectively. As can be seen from FIG. 3, the pins 84 and 86 are spaced by different distances from the axis of the piston rod.

The apparatus just described operates as follows:

After a tank base blank 10 has been placed on the frame 12, the blank 10 is aligned and securely clamped by means of the mechanism 18. The piston-cylinder unit 24 exerts a downward pressure on the blank 10 through the pressure plate 26 so holding the blank firmly against the frame 12. The flanging device 30 is then brought up to the blank by an operative without power assistance because of the counter balancing of the device described above. The piston 70 of the hydraulic cylinder 68 is retracted and the clamping wheel 64 is located below the tube 12, the wheel 64 having been rotated to bring a matching part of its outer contour into contact with tube 12, after which the piston 70 is extended. The pair of pressure pads 80, 82 are thereby located on the upper side of the blank 10 in such a manner that the pad 80 exerts a clamping force and the pad 82 initiates a bending operation on the blank edge. By extending piston 70 further, the pads 82 now press the outer edge region of the blank 10 downwards, and in a first operating step the edge region is advantageously turned down by approximately 45°.

That process is now repeated progressively over the entire periphery of the blank, it being possible in each case to complete an entire side of the blank rectangle by moving the device 30 along the edge of the blank, after which the table 14 is turned through approximately 90°. The position of the device 30 during this first run is seen in FIG. 1. After treating the entire periphery the device 30 is rotated anti-clockwise, but with the clamping wheel still adjacent to the template tube, and the process repeated to bring the edge region of the blank completely into a desired inclination with respect to the face of the blank.

It should be noted that the bending at any point of the periphery of the blank has another dimension, dependent on the arching of the blank. It may therefore simplify the operation if the angular position of the clamping wheel 64 is predetermined for the two operating steps or at least for the second one, for example by means of a stop on the table. FIG. 3 shows this end position, in which the bending is completed. FIG. 1 also shows a foot switch 90 controlling rotation of the table 14.

For automatic guide of the device 30, the latter is provided with drive elements which effect an automatic advance of the device along the edge of the blank.

The support for the workpiece and the suspension for the actual flanging device described above with reference to FIGS. 1 and 2 may also be used in conjunction with the devices shown in FIGS. 4–9, but this is not essential. If desired, for example, a simple supporting frame is sufficient, on which the workpiece is supported approximately horizontally in such a manner that its edges are freely accessible for the bending or flanging operation.

The device shown in FIGS. 4–7 comprises the yoke 110 of approximately C-shape, which, as mentioned, may be suspended from a counter-balanced support structure. A supply line for the pneumatic or hydraulic powering of a pressure pad 114 is indicated at 112.

Attached to the lower arm 116 of the yoke 110 is a support member which, in this case, is in the form of an anvil 118. In this embodiment the anvil 118 has a plane clamping face 120, extending at least approximately perpendicular to the axis of movement of pressure pad 114 as well as a template region 122, whose contour determines the shape of the bending to be imposed on a blank. In this case, therefore, a fixed support member is superfluous.

On the middle section 124 of the yoke 110 guides 126 are pivotally mounted by means of a pin 128. The free end of the guides are joined by means of a joint bolt 130. The axes of the pin 128 and of the bolt 130 are parallel to each other and to the clamping face 120.

Mounted on the joint bolt 130 is a pressure pad 132. As may be seen in FIG. 5, it has two symmetrical bearing arms 134, so giving the U-shaped contour seen in FIG. 5. Mounted on the middle section and clear of the joint bolt 130 is a bending lever 136, which has its upper side formed as a curved cam path 138. At the free end of the bending plate lever a pressure pad 140 is interchangeably mounted; the anvil 118 is also, of course, interchangeable.

The pressure pad 114 is in contact with the cam path 138, as may be seen in FIG. 4. The contour of the bending plate lever is such that the cam path 138 is always proud of the guides 126, so that even in the lowest position of the pad 114, which is shown in FIG. 4, the pad is still in contact with the cam path 138 and can maintain pressure thereon. Each time the pad 114 is fully retracted the pressure pad 132 is loose, the under side of this pad lying opposite the clamping face 120.

A stop 142 is secured laterally below the pin 128 in such a manner that it is displaceable through the middle section 124 of the yoke 110. It is also possible to provide stops at both ends so that it is possible during operation to move in both directions along the edge of the blank.

The bending pad 140 shown in FIGS. 4 and 5 is simply provided with a flat end face facing the piece of sheet metal. It has been shown, however, that a neater bending can be achieved if a bending pad 140 shown in FIG. 6 or 7 is used. These bending pads 140' and 140'' have an end face, i.e. that facing the blank, subdivided into three portions. The middle portion 141 is solid and formed in one piece with a foot plate 144, the face thereof that is remote from the portion 141 containing threaded bores or the like for attaching to the bending lever 136. At both sides of the solid middle portion 141 resilient cushions 143 are secured to the foot plate 144. Each cushion has a face plate 145 which in the rest position of the device may project somewhat beyond the bearing surface of the middle portion 141. In operation, the face plates 145 are placed somewhat flexibly against the edge of the blank, and the actual bending force is transmitted by means of the solid middle portion 141.

In the embodiment shown in FIG. 7, the face plates 145' are supported against flanges 147, formed in the foot plate which accordingly has an E-shaped profile. Accordingly, the support by the cushions 143' is flexible only close to the solid middle portion (not shown in FIG. 7), the side plates 145' tilting about their respective supporting flanges.

In contrast to the embodiment shown in FIGS. 1–3, in which the device pivoted about the support frame 12, in this second embodiment, the position of the C-shaped yoke is stationary relative to the workpiece to be processed and the bending is carried out because the workpiece is clamped fast between the clamping face 120 and the movable pressure pad 132. It is only the bending lever 136 which is pivoted. Operation of the device shown in FIG. 4 is somewhat more involved than that of the device shown in FIG. 3 but can be simplified if, as in the device shown in FIG. 3, the entire device follows the bending movement. The embodiments shown in FIGS. 8–10 are designed accordingly.

The embodiment shown in FIG. 8 again has a C-shaped yoke 150 with a pressure fluid connection 152 and a pressure pad 154. There is rigidly fixed to the pad 154 a solid patrix (pattern or die) 156, and a bending template, in the form of an anvil 160, is attached to the lower arm 158 of the yoke 150. Die 156 and anvil 160 are, of course, exchangeable. As in the case described hereinbefore, a stop 162 is provided.

The die has a broad supporting foot portion 164 remote from the stop 162, and a bending foot portion 166 adjacent the stop, and has, in the area lying between, a concave surface 168. The bending foot portion is, viewed in a direction perpendicular to the drawing plane of FIG. 8, considerably narrower than the supporting foot portion 164 so that it engages centrally with regard to the supporting foot portion. In addition, the distance between the zone of contact between blank and supporting foot portion and that between blank and anvil is clearly greater than the distance between the latter contact zone and the zone of contact between the bending foot portion and the blank at the commencement of a bending operation. As a result of these features there is no deformation of the blank in the region of the supporting foot portion during the pressure stroke of the pad 154. Instead, the entire device pivots about the contact zone of the foot portion with the blank so that the edge of the sheet metal blank is drawn round the anvil by the bending foot portion. The profile of the bending foot portion may be seen in FIG. 9.

In the embodiment shown in FIG. 10, the C-shaped yoke is not rigid but has jaw pieces hinged to one another. The lower jaw piece 170 is connected to the cylinder 172 of a fluid operated piston cylinder unit, the piston of which engages with the upper jaw piece 173 which thus pivots about the joint bolts 174. The upper jaw piece carries the die, the lower jaw piece the anvil, these being of a design similar to those described above with reference to FIGS. 8 and 9. Whereas in the latter two Figures the stop was of similar design to that in FIG. 4, in this case the stop 176 is L-shaped, the lower transverse arm being provided with the longitudinal hole provided to permit adjustment; whereas the vertical arm determines, with the edge that faces the anvil, the depth of insertion of the device.

We claim:

1. Apparatus for bending the outer edge of sheet metal members into a predetermined form, comprising:

a yoke substantially having a C-shaped contour in the direction of said edge and extending substantially transverse to said edge on both sides thereof;

a support member for supporting said sheet metal member and being engaged with one of the legs of said yoke, and being adapted to the contour of a sheet metal member and including a tube;

said yoke further including a centering element for engagement with said support member;

a tool carrier mounted on said yoke and movable relative thereto;

tool means carried by said tool carrier and comprising a clamping member for retaining said sheet metal member against said support member, and a bending member adapted to engage the edge of said sheet metal member and bend it about said support member;

reciprocating drive means connected to said yoke for actuating said clamping member and said bending member and to move said tool carrier relative to said support member.

2. Apparatus for bending the outer edge of sheet metal members into a predetermined form, comprising:

a yoke substantially having a C-shaped contour in the direction of said edge and extending substantially transverse to said edge on both sides thereof;

a support member for supporting said sheet metal member and being engaged with one of the legs of said yoke;

a tool carrier mounted on said yoke and movable relative thereto;

tool means carried by said tool carrier and comprising a clamping member for retaining said sheet metal member against said support member, and a bending member adapted to engage the edge of said sheet metal member and bend it about said support member;

reciprocating drive means connected to said yoke for actuating said clamping member and said bending member and to move said tool carrier relative to said support member;

apparatus for supporting the device in a work position, and means for suspending the device from a support and means for counter-balancing the weight of the device.

3. Apparatus for bending the outer edge of sheet metal members into a predetermined form, comprising:

a yoke substantially having a C-shaped contour in the direction of said edge and extending substantially transverse to said edge on both sides thereof;

a support member for supporting said sheet metal member and being engaged with one of the legs of said yoke;

a tool carrier mounted on said yoke and movable relative thereto;

tool means carried by said tool carrier and comprising a clamping member for retaining said sheet metal member against said support member, and a bending member adapted to engage the edge of said sheet metal member and bend it about said support member;

reciprocating drive means connected to said yoke for actuating said clamping member and said bending member and to move said tool carrier relative to said support member; and a rotary table on which said support member is mounted in a manner such that the entire peripheral area of said sheet metal member is movable into the work position of the device.

4. A device as in claim 1 in which said centering element is a clamping wheel having a peripheral contour complementary with respect to that of said tube.

5. A device as in claim 1 wherein said support member is releasably attached to another arm of the yoke, the contour of said support member being such that the edge of a sheet metal member undergoing bending is drawn around said support member by movement of said bending member, and further comprising stop means for determining the line of bend relative to the edge of the sheet metal member.

6. A device as in claim 5 wherein said yoke further includes a pair of guides pivotally mounted thereon, said clamping member being a pressure pad pivotally attached to one of said guides for cooperation with said support member, and said bending member being also pivotally mounted upon the other of said guides, said bending member including a pressure pad for cooperation with said support member to effect bending of the edge of the sheet metal member.

7. A device as in claim 6 wherein said pressure pads each include a rigid center portion and, on each side thereof, a resiliently supported face plate.

8. A device as in claim 7 in which said face plates are pivotally supported at positions spaced from said center portion.

9. A device as in claim 5 wherein said bending member is a die with an operating face contoured asymetrically with respect to said support member whereby bending of the edge portion of said sheet metal member is effected by contact thereof with said face and said device pivoting about the contact between said face and said sheet metal member.

10. A device as in claim 9 wherein said operating face includes a supporting portion for first contacting said sheet metal member, and a bending portion for bending the edge of said sheet metal member around said supporting portion during pivotal movement of the device, said supporting portion being broader than said bending portion.

11. A device as in claim 10 wherein said supporting portion first contacts said sheet metal member at a zone spaced further from a first contact zone between said support member and said sheet metal member than the zone at which said bending portion first contacts said sheet metal member.

12. A device as in claim 5 wherein said yoke comprises first and second jaw pieces hinged together, and said first jaw piece carries a die and said second jaw carries a blank supporting member which determines the contour of the bend to be imparted to said sheet metal member.

13. A device as in claim 12 wherein said drive means actuates said jaw pieces.

* * * * *